United States Patent [19]

Allen

[11] Patent Number: 5,040,733

[45] Date of Patent: Aug. 20, 1991

[54] AIR DRIVEN HYDRAULIC SPRAYING SYSTEM

[76] Inventor: Ernest W. Allen, 607 East Miller Road, Midland, Mich. 48640

[21] Appl. No.: 530,105

[22] Filed: May 17, 1990

Related U.S. Application Data

[63] Continuation-in-part of Ser. No. 360,105, Jun. 1, 1989, abandoned.

[51] Int. Cl.[5] ..... B05B 3/18

[52] U.S. Cl. ..... 239/752

[58] Field of Search ..... 239/750, 752, 753; 92/81; 188/269; 267/64.13

[56] References Cited

U.S. PATENT DOCUMENTS

| | | | |
|---|---|---|---|
| 2,430,019 | 11/1947 | Jenkins | 92/81 X |
| 4,235,421 | 11/1980 | Phillips | 239/752 X |
| 4,257,442 | 3/1981 | Claycomb | 137/238 |
| 4,402,459 | 9/1983 | Berry | 239/752 |
| 4,838,492 | 6/1989 | Berry | 239/752 |

*Primary Examiner*—Andres Kashnikow
*Assistant Examiner*—William Grant
*Attorney, Agent, or Firm*—Merlin B. Davey

[57] ABSTRACT

An air driven hydraulic system for spraying liquids comprising a double acting cylinder having a central piston with an oil supply on one side of said piston and air on the other side of said piston and means of alternately controlling the supply of air and oil to the cylinder.

4 Claims, 3 Drawing Sheets

AIR DRIVEN HYDRAULIC SPRAYING SYSTEM

CROSS-REFERENCE TO RELATED APPLICATION

This application is a continuation-in-part of application Ser. No. 360,105 filed June 1, 1989, now abandoned.

BACKGROUND OF THE INVENTION

A continuing problem in the application of liquid materials such as, for example, paints, fertilizers, herbicides, insecticides and other treatment liquids, including solutions and suspensions, is that of insuring a desired, uniform application. Clearly, non-uniform application will provide non-uniform results and such results will vary from ineffective treatment to excessive treatment which can be both costly and damaging in some uses, such as in agricultural sprays.

Various attempts have been made to overcome these problems, as seen, for example, in U.S. Pat. Nos. 3,902,667 and 4,260,107. Such systems generally employ pumps and it has been found that pumps do not always deliver a constant volume because of several factors such as wear, clogging or a variation in the power to the pump itself. Electrically controlled systems, because of the possibility of igniting volatile carriers, are not desirable for safety reasons, particularly when liquids are to be sprayed in relatively confined spaces.

In addition, hitherto employed hydraulic systems do not permit the high speeds, i.e., up to 4 to 5 miles per hour, needed for the experimental simulation of the speeds used when tractor spraying in field applications. Such speeds are necessary for the coordination of experimental data with field use.

SUMMARY OF THE INVENTION

This invention provides an air-driven hydraulic system for spraying liquids. More particularly, the invention provides an air-driven hydraulic system for spraying liquids comprising a double acting cylinder having a central piston with an oil supply to one side of the piston and an air supply to the other side of the piston, means for alternately controlling the supply of air and oil to the cylinder thereby moving the piston in opposite directions as desired. The apparatus of this invention further comprises a rail or track having a mobile carrier positioned thereon, said carrier being adapted to be reciprocally moved by cable means attached to said piston and said carrier, means for controlling the flow of oil from the cylinder to control the acceleration and then the speed of said carrier at a desired and accurate uniform level, e.g., up to 5 or more miles per hour, during the spraying cycle and means for venting air from the cylinder thereby permitting a high flow of oil and a high speed return of said carrier to the start position. A spray canister is attached to said carrier and is connected to a source of pressurized air, or other inert gas, by a coiled, flexible hose.

DESCRIPTION OF THE PREFERRED EMBODIMENT

The invention is further illustrated by the accompanying drawings wherein.

Figure 1:
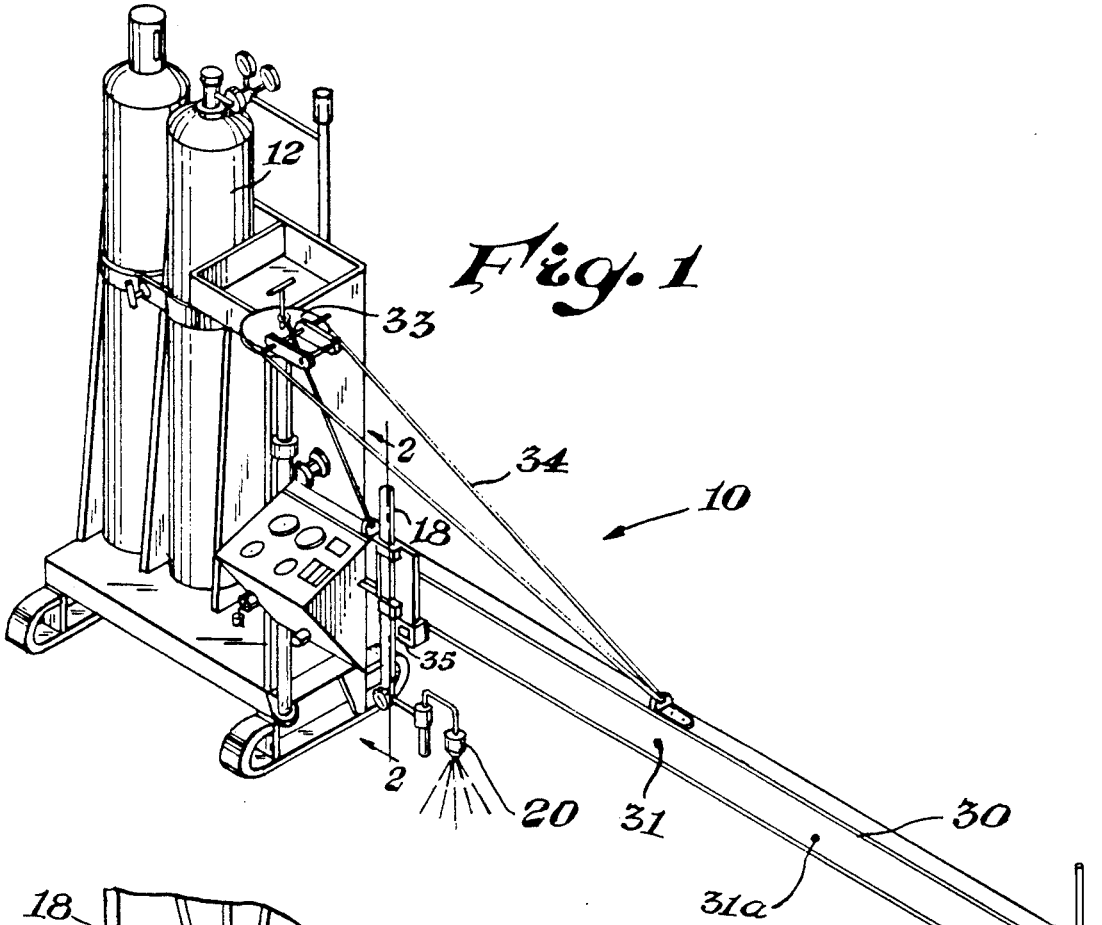
FIG. 1 is an isometric view of one embodiment of the apparatus of this invention illustrating a mobile unit.
Figure 2:
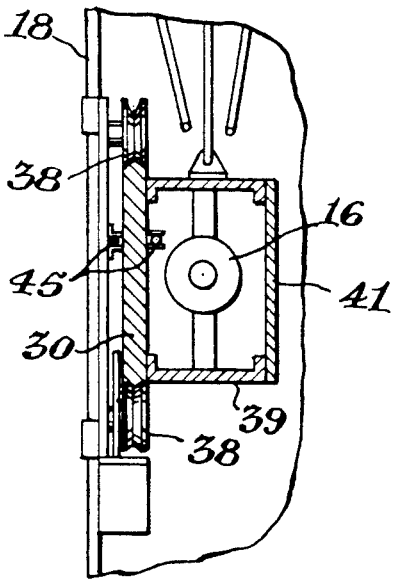
FIG. 2 is a sectional view taken along the line 2—2 of FIG. 1.
Figure 3:
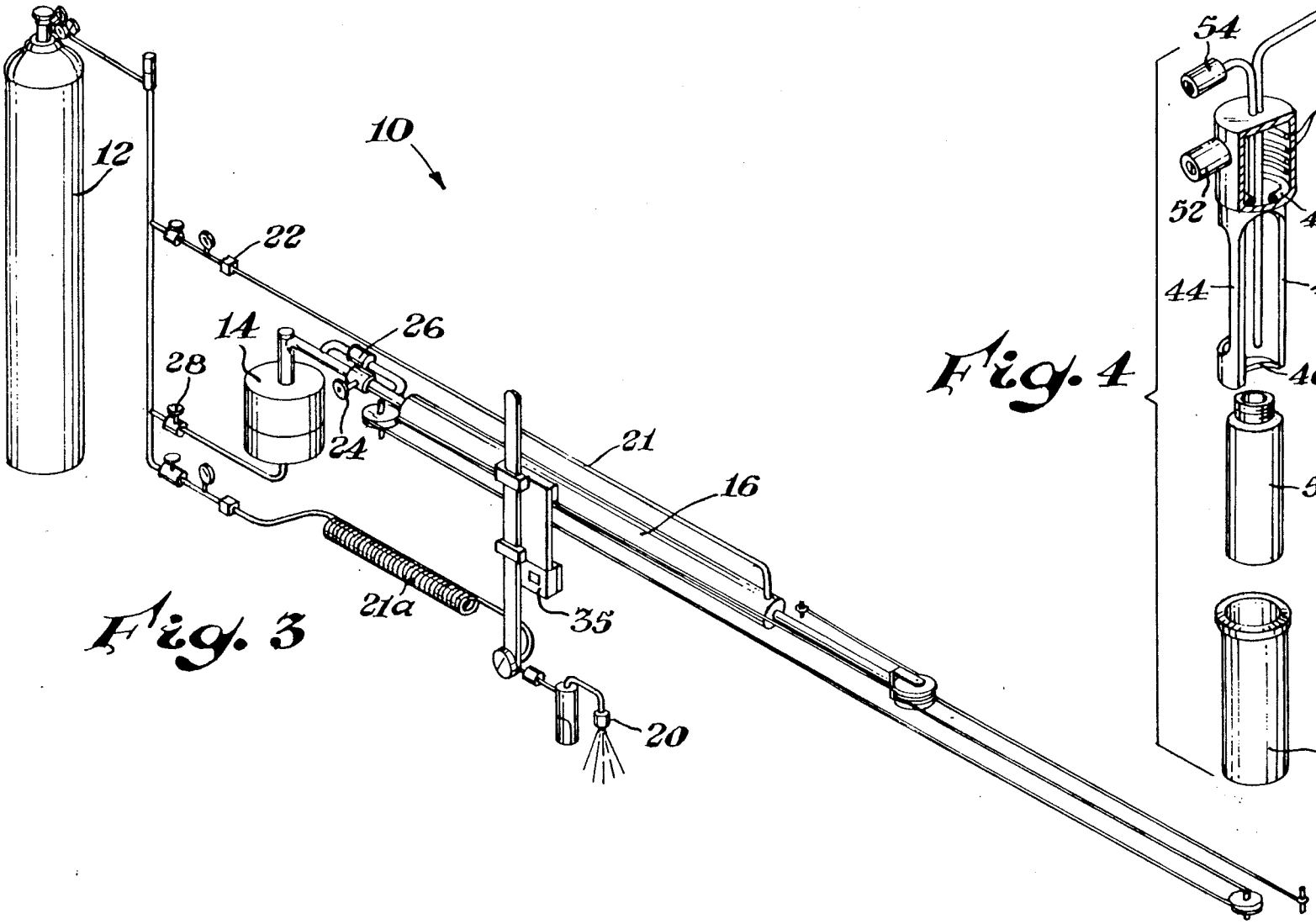
FIG. 3 is an isolated isometric view of the air-driven hydraulic system of the invention illustrated in FIG. 1.

As shown in the accompanying FIGS. 1 to 3, air, or other inert gas, is supplied to the system (10) from, for example, a compressed air tank (12), generally at a pressure of about 80 psi (gauge) and oil is supplied from a tank, such as, for example, a bladder tank (14). It will further be seen that by means of the indicated cable hook-up, (FIG. 3), the piston inside cylinder (16), not shown, will travel only ½ the distance traveled by the carrier (18) and attached spraying head (20). As indicated in FIG. 3, air is supplied to the spray canister through air supply line and coil (21*a*). It is also to be noted that the carrier travel is always opposite to the direction of the piston travel. Thus, air provided through three-way valve (22), to the cylinder (16) drives the piston to the left and forces the carrier (18) to the right. The desired speed of carrier movement is controlled and set by speed control flow valve (24). Actual spraying is controlled by on-off switches 31 and 31*a* (FIG. 1) respectively, and is timed by a stop watch timer 35. Because the air pressure is constant, the speed of travel of the carrier to the right is constant at the desired setting and spray dispersal will be uniform. After the spraying action, the three-way valve (22) permits the rapid venting of air from the cylinder, the oil pressure will force the piston to the right and the cable means will retract the carrier to the start position, the by-pass check valve (26) permitting a high flow of oil and a high speed return of the carrier to the start position.

Air pressure in the bladder tank (14) is advantageously controlled by, for example, a fast bleeding regulator (28), at a pressure of about 12 psi (gauge). The rate of bleeding off of air pressure through the fast bleeding regulator determines the acceleration of the carrier and spraying head as they are moving to the right.

Figure 5:
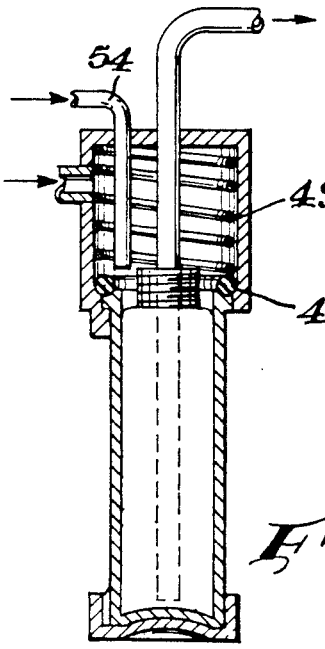
FIG. 5 is a sectional view of the spray canister of this invention showing the vial in place in the canister.
Figure 4:
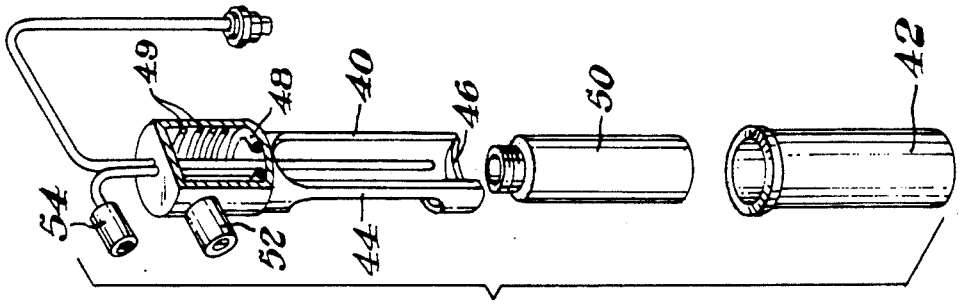
FIG. 4 is an exploded view, partially in section of the unique spray canister of this invention.

The spraying head 20 is attached to a spray canister shown in FIGS. 4 and 5 having an outer housing (40) and an inner housing (42), each housing having a slightly concave base. The outer housing comprises generally oppositely disposed openings (44) and (46). Opening (46) being adapted to receive the inner housing (42) which is inserted therein and comes into contact with O-ring (48) which is held in place by coil spring (49), forming an instant seal therewith. Opening (44) is adapted for applying hand pressure for removal of inner housing (42) by finger pressure of one hand.

As can be seen in FIG. 4, the solution to be sprayed is placed in vial 50 which is then inserted into inner housing 42 and the combination is inserted into outer housing 40. As can be seen in FIG. 4, air pressure applied through inlet 52 forces the solution out through spraying head 20. Because the pressure is uniform on all sides of vial 50, said vial need not be made of pressure resistant material. The timing of the spray application is controlled by contacts 31 and 31*a* on rail 30 as seen in FIG. 1. If it is desired to rinse the vial 50 and spray head 20 after the spray application is complete, a rinse solution, for example, acetone, can be applied through inlet 54.

One embodiment of the rail or track assembly is shown in FIG. 2, wherein it is seen that carrier (18) is carried along rail (30) by rollers (38) and that cylinder (16) is disposed on the back or rear side of rail (30) within housing (39) which housing advantageously has a removable cap (41) for maintenance purposes. The cable attachments for moving the carrier are illustrated (45).

Figure 6:
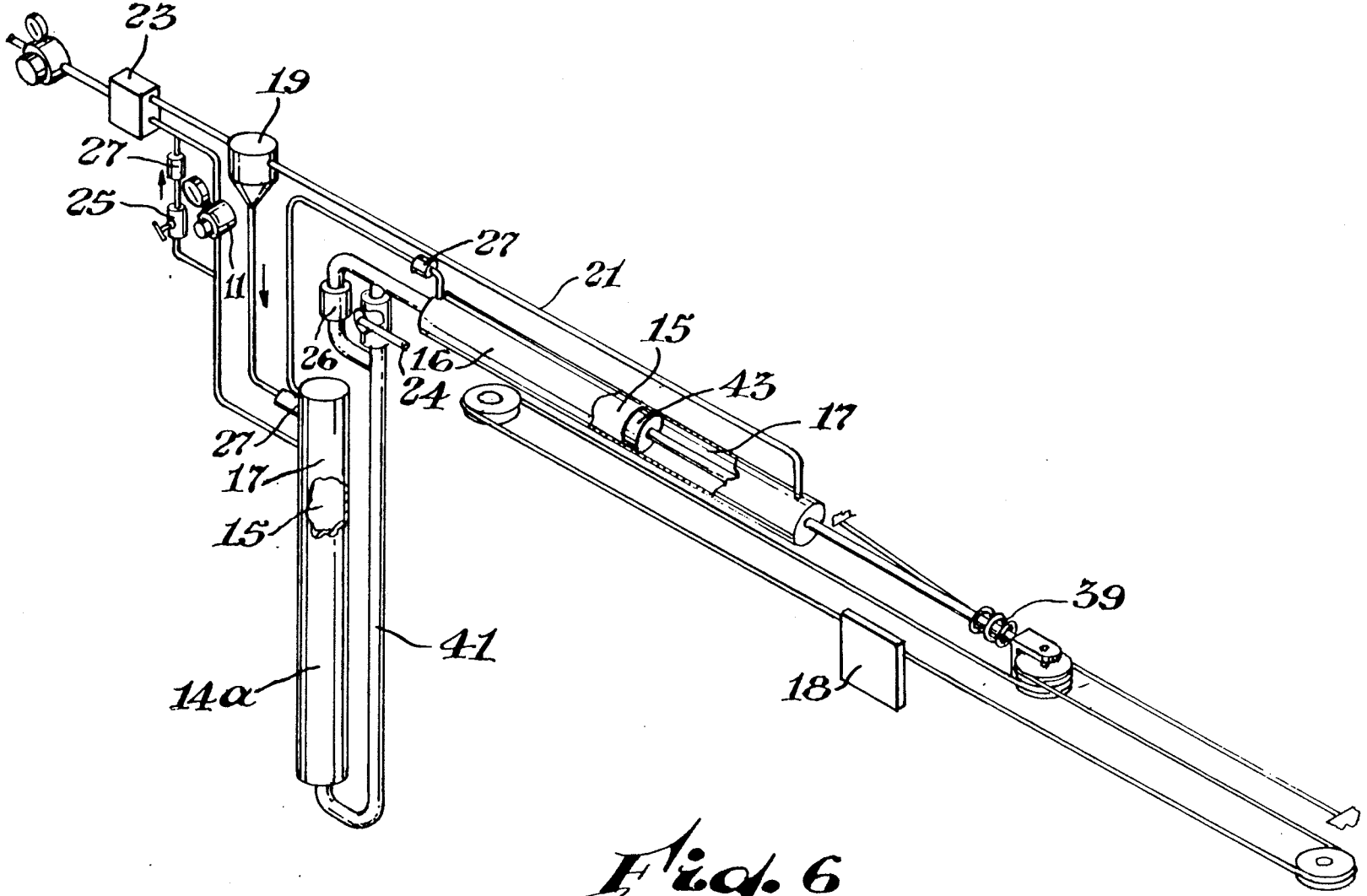
FIG. 6 is an isometric view, partly in section, of another embodiment of apparatus in accordance with the present invention.

FIG. 6 illustrates a modified system in accordance with the present invention wherein a vertical oil tank (14*a*) is employed instead of the bladder tank (14) of FIG. 1. In this system, check valves (27) and oil dump trap (19) serve to maintain the separation of air (17) and oil (15) in tank (14*a*). In this system oil line (41) is seen to be quite large, e.g., having an inside diameter of about ¾ inch, permitting a rapid flow of oil, by-pass check valve (26) and speed control flow valve (24) serving the same functions as in FIG. 3. Four-way valve (23), in conjunction with acceleration control valve (25), provide means for controlling the acceleration prior to the start of the spraying cycle, as is done with fast bleeding regulator (28) of the apparatus illustrated in FIG. 3, so that the desired speed during the spraying cycle can be quickly attained and the actual spraying can be carried out uniformly. Four-way valve (23), when permitting the flow of air through regulator (11), pressurizes the oil tank (14*a*) by-passing control valve (24) by going through check valve (26), causing the carrier to return to the start position at a desired high speed each time regardless of the speed used during the spraying cycle. Spring (39) serves to cushion the shock of stopping the high speed movement of piston (43), when the carrier is returning to the start position.

The apparatus of this invention may be stationary, as for example, for use in a hood or other enclosure when spraying potted plants in a greenhouse, or it may be adapted for field use as a mobile unit for drawing behind a tractor or other vehicle. When employed for such field use, the rail or track (30) is advantageously mounted as shown in FIG. 1. The rotatable mount (33) and cable suspension (34) allows the track to swing backward or forward if struck by an object but brings the track back to the set position very quickly. The track can be raised to the vertical for storage if desired.

Various modifications may be made in the apparatus of the present invention without departing from the spirit or scope thereof and it is understood that I limit myself only as defined in the appended claims.

I claim:

1. An air driven hydraulic system for spraying liquids comprising a double acting cylinder positioned relative to a rail or track, said cylinder having a piston positioned therein, said piston having a first end and a second end, and having an oil supply to said first end of said piston and an air supply to the second end of said piston, said hydraulic system having means for alternately controlling the supply of air and oil to said cylinder to move said piston in alternating directions, said rail or track having a mobile carrier positioned thereon and being moved by means attached to said piston and said carrier, the acceleration of said carrier being controlled by bleeding off air from said means for controlling the supply of air and oil, and the speed of said carrier being controlled by the flow of oil from said piston, and means for adjusting the bleeding off of air and the flow of oil to independently control the acceleration and speed of said carrier.

2. System of claim 1 wherein the means for controlling the supply of air and oil to the cylinder comprises a tank wherein the air and oil are separated from each other.

3. System of claim 1 wherein the double acting cylinder is fixedly positioned parallel to a rail or track, said mobile carrier being reciprocally moved by cable means attached to said piston and said carrier when said piston is moved by alternating the supply of oil and air.

4. System of claim 1 wherein the means for adjusting the speed of carrier movement while spraying is a hydraulic speed control flow valve.

* * * * *